United States Patent [19]

Baldwin et al.

[11] 4,115,286

[45] Sep. 19, 1978

[54] LUBRICANT ANTIWEAR ADDITIVES CONTAINING SULFUR AND BORON

[75] Inventors: Bernard A. Baldwin; Ralph P. Williams, both of Bartlesville, Okla.; Raymond Rohde, Sun City, Ariz.

[73] Assignee: Phillips Petroleum Company, Bartlesville, Okla.

[21] Appl. No.: 802,082

[22] Filed: May 31, 1977

[51] Int. Cl.[2] ..... C10M 1/54; C10M 3/48; C10M 5/28; C10M 7/52

[52] U.S. Cl. ..... 252/46.3; 260/462 R

[58] Field of Search ..... 252/46.3; 260/462 R

[56] References Cited

U.S. PATENT DOCUMENTS

| | | | |
|---|---|---|---|
| 2,312,208 | 2/1943 | Clayton et al. | 252/46.3 |
| 3,224,971 | 12/1965 | Knowles et al. | 252/46.3 |
| 3,303,130 | 2/1967 | Scypinski et al. | 252/46.3 |
| 3,442,807 | 5/1969 | Law | 252/46.3 |
| 3,533,990 | 10/1970 | Cyba | 252/46.3 |

*Primary Examiner*—Irving Vaughn

[57] ABSTRACT

Lubricating compositions incorporating therein at least one mercapto-substituted boron-containing compound selected from 2-hydroxy-4-(mercaptohydrocarbyl)-1,3,2-dioxaborolanes and alkylammonium bis[(mercaptohydrocarbyl)ethylenedioxy]borates. Novel 2-hydroxy-4-(mercaptohydrocarbyl)-1,3,2-dioxaborolanes and novel alkylammonium bis[(mercaptohydrocarbyl)ethylenedioxy]borates and methods for preparing these compositions of matter are provided. Alkylammonium bis[(mercaptohydrocarbyl)ethylenedioxy]borates are prepared from an intermediate chemical compound that is a novel hydrogen bis[(mercaptohydrocarbyl)ethylenedioxy]borate for which a method of preparation is also provided.

25 Claims, No Drawings

LUBRICANT ANTIWEAR ADDITIVES CONTAINING SULFUR AND BORON

BACKGROUND OF THE INVENTION

This invention relates to compounds containing boron and sulfur. In one of its aspects this invention relates to mercapto-substituted boron-containing compounds. In another of its aspects this invention relates to methods for preparing mercapto-substituted boron-containing compounds. In yet another aspect this invention relates to lubricant additives. In still another aspect this invention relates to improving antiwear properties of lubricating compositions.

Many lubricants, such as lubricating motor oils, require efficient antiwear additives to prevent or reduce scuffing or unreasonable wear caused by contact of moving metal parts. Indeed, such antiwear additives are essential for the satisfactory lubrication of modern high-compression internal combustion engines. The present invention provides novel compounds which have been discovered to be useful as antiwear additives in lubricating compositions.

It is therefore an object of this invention to provide lubricating compositions. It is another object of this invention to provide a method for improving the antiwear properties of lubricating compositions. It is still another object of this invention to provide novel compositions of matter that are useful as antiwear additives for lubricating compositions. It is still another object of this invention to provide methods for preparing novel compositions of matter that are useful as antiwear additives for lubricating compositions. It is yet another object of this inventin to provide a novel composition of matter that is an intermediate chemical in the preparation of antiwear additives for lubricating compositions. It is another object of this invention to provide a method for preparing a novel composition of matter that is an intermediate in the preparation of antiwear additives for lubricating compositions.

Other aspects, objects, and the several advantages of this invention will become apparent upon reading this specification and the appended claims.

Statement of the Invention

In accordance with this invention, the antiwear properties of a lubricating composition are improved, as compared to lubricating compositions without the hereinafter named additives, by incorporating therein a minor amount of at least one mercapto-substituted boron-containing compound selected from the group consisting of 2-hydroxy-4-(mercaptohydrocarbyl)-1,3,2-dioxaborolanes and alkylammonium bis[(mercaptohydrocarbyl)ethylenedioxy]borates. Also, according to this invention, novel 2-hydroxy-4-(mercaptohydrocarbyl)-1,3,2-dioxaborolanes are provided by contacting boric acid with at least one mercapto-substituted vicinal diol in a molar ratio of substantially 1:1, with removal of by-product water. Further, according to this invention, novel hydrogen bis[(mercaptohydrocarbyl)ethylenedioxy]borates are provided by contacting boric acid with at least one mercapto-substituted vicinal diol in a molar ratio of substantially 0.5:1, respectively, with removal of by-product water. Still further, according to this invention, novel alkylammonium bis[(mercaptohydrocarbyl)ethylenedioxy]borates are provided by contacting at least one hydrogen bis[(mercaptohydrocarbyl)ethylenedioxy]borate with at least one alkylamine.

2-Hydroxy-4-(mercaptohydrocarbyl)-1,3,2-dioxaborolanes which can be produced by this reaction of boric acid with mercapto-substituted vicinal diols in accordance with one aspect of this invention and which can be used as antiwear additives in lubricating compositions of this invention can be represented by the formula

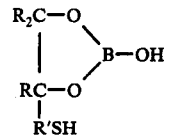

where each R is selected from the group consisting of hydrogen, alkyl, cycloalkyl, and aryl, and combinations thereof such as alkaryl, aralkyl, and the like, the number of carbon atoms in each R being within the range of 0 to about 8, and R′ is a divalent hydrocarbon radical selected from alkylene, cycloalkylene, and arylene, the number of carbon atoms in R′ being within the range of 1 to about 6.

Examples of some 2-hydroxy-4-(mercaptohydrocarbyl)-1,3,2-dioxaborolanes which can be employed in lubricating compositions of this invention include 2-hydroxy-4-(mercaptomethyl)-1,3,2-dioxaborolane, 2-hydroxy-4-(2-mercaptoethyl)-1,3,2-dioxaborolane, 2-hydroxy-4-(3-mercaptopropyl)-4,5-dimethyl-5-ethyl-1,3,2-dioxaborolane, 2-hydroxy-4-(3-mercaptobutyl)-4-isopropyl-5-isobutyl-1,3,2-dioxaborolane, 2-hydroxy-4-(2-methyl-5-mercaptopentyl-4,5-dihexyl-1,3,2-dioxaborolane, 2-hydroxy-4-(6mercaptohexyl)-4,5,5-trioctyl-1,3,2-dioxaborolane, 2-hydroxy-4-(4-mercaptocyclohexyl)-4,5-diphenyl-1,3,2-dioxaborolane, 2-hydroxy-4-(3-mercaptocyclopentyl)-4,5-di-m-tolyl-1,3,2-dioxaborolane, 2-hydroxy-4-(2-mercaptophenyl)-4,5-dibenzyl-1,3,2-dioxaborolane, 2-hydroxy-4-(4-mercaptophenyl)-4,5-dicyclohexyl-1,3,2-dioxaborolane, 2-hydroxy-4-(mercaptomethyl)-4-(3-methylcyclopentyl)-5-(cyclohexylmethyl)-1,3,2-dioxaborolane, and the like, and mixtures thereof.

Alkylammonium bis[(mercaptohydrocarbyl)ethylenedioxy]borates which can be produced by the reaction of alkylamines with hydrogen bis[(mercaptohydrocarbyl)ethylenedioxy]borates in accordance with one aspect of this invention and which can be used as antiwear additives in lubricating compositions of this invention can be represented by the formula

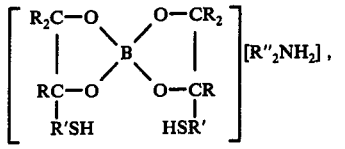

where each R and each R′ are as defined above, and each R″ is selected from the group consisting of hydrogen and alkyl, the sum of the numbers of carbon atoms in the two R″ groups being within the range of about 8 to about 24.

Examples of some alkylammonium bis[(mercaptohydrocarbyl)ethylenedioxy]borates which can be employed in lubricating compositions of this invention include octylammonium bis[(mercaptomethyl)e-thylenedioxy]borate, octadecylammonium bis[(mercaptomethyl)ethylenedioxy]borate, dibutylammonium bis[(2mercaptoethyl)ethylenedioxy]borate, dihexylammonium bis[1-(3-mercaptopropyl)-1,2-dimethyl-2-ethylethylenedioxy]borate, 2-ethyldecylammonium bis[1-(3-mercaptobutyl)-1-isopropyl-2-isobutylethylenedioxy]borate, N-ethyldodecylammonium bis[1-(2-methyl-5-mercaptopentyl)-1,2-dihexylethylendioxy]borate, tetracosylammonium bis[1-(6-mercaptohexyl)-1,2,2-trioctylethylenedioxy]borate, N-methylhexadecylammonium bis[1-(4-mercaptocyclohexyl)-1,2-diphenylethylenedioxy]borate, eicosylammonium bis[1-3-mercaptocyclopentyl)-1,2-di-m-tolylethylenedioxy]borate, didecylammonium bis[1-(2-mercaptophenyl)-1,2-dibenzylethylenedioxy]borate, hexadecylammonium bis[1-(3-mercaptophenyl-1,2-dicyclohexylenedioxy]borate, decylammonium bis[1-(mercaptomethyl)-1-(3-methylcyclopentyl-2-(cyclohexylmethyl)ethylenedioxy]borate, tridecylammonium [(mercaptomethyl)ethylenedioxy] [(2-mercaptoethyl)ethylenedioxy]borate, and the like, and mixtures thereof.

Hydrogen bis[(mercaptohydrocarbyl)ethylenedioxy]borates which can be produced by the reaction of boric acid with mercapto-substituted vicinal diols in accordance with one aspect of this invention and which can be used in the preparation of the alkylammonium bis[(mercaptohydrocarbyl)ethylenedioxy]borates can be represented by the formula

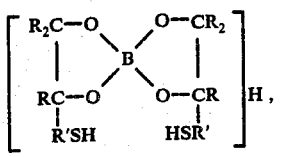

where each R and each R′ are as defined above. Examples of some hydrogen bis[(mercaptohydrocarbyl)ethylenedioxy]borates which can be used in the preparation of the alkylammonium salts include hydrogen bis[(mercaptomethyl)ethylenedioxy]borate, hydrogen bis[(2-mercaptopropyl)ethylenedioxy]borate, hydrogen bis[1-(3-mercaptopropyl)-1,2-dimethyl-2-ethylethylenedioxy]borate, hydrogen bis[1-(3-mercaptobutyl)-1-isopropyl-2-isobutylethylenedioxy]borate, hydrogen bis[1-(2-methyl-5-mercaptopentyl)-1,2-dihexylethylenedioxy]borate, hydrogen bis[1-(6-mercaptohexyl)-1,2,2-trioctylethylenedioxy]borate, hydrogen bis[1-(4-mercaptocyclohexyl)-1,2-diphenylethylenedioxy]borate, hydrogen bis[1-(3-mercaptocyclopentyl)-1,2-di-m-tolylethylenedioxy]borate, hydrogen bis[1-(2-mercaptophenyl)-1,2-dibenzylethylenedioxy]borate, hydrogen bis[1-(3-mercaptophenyl)-1,2-dicyclohexylethylenedioxy]borate, hydrogen bis[1-(mercaptomethyl)-1-(3-methylcyclopentyl)-2-(cyclohexylmethyl)ethylenedioxy]borate, hydrogen [(mercaptomethyl)ethylenedioxy][(2-mercaptoethyl)ethylenedioxy]borate, and the like, and mixtures thereof.

Alkylamines which can be used in the preparation of the alkylammonium bis[(mercaptohydrocarbyl)ethylenedioxy]borates can be represented by the formula $R''_2NH$, where R″ is as defined above. Examples of some alkylamines which can be used in the preparation of the alkylammonium salts include octylamine, octadecylamine, dibutylamine, dihexylamine, 2-ethyledecylamine, N-ethyldodecylamine, tetracosylamine, N-methylhexadecylamine, eicosylamine, didecylamine, hexadecylamine, decylamine, tridecylamine, and the like, and mixtures thereof.

Mercapto-substituted vicinal diols which can be used in the preparation of the 2-hydroxy-4-(mercaptohydrocarbyl)-1,3,2-dioxaborolanes and hydrogen bis[(mercaptohydrocarbyl)ethylenedioxy]borates can be represented by the formula

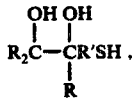

where each R and R′ are as defined above. Examples of some mercapto-substituted vicinal diols which can be used in the preparation of the 2-hydroxy-4-(mercaptohydrocarbyl)-1,3,2-dioxaborolanes and hydrogen bis[(mercaptohydrocarbyl)ethylenedioxy]borates include 3-mercapto-1,2-propanediol, 4-mercapto-1,2butanediol, 3,4-dimethyl-7-mercapto-3,4heptanediol, 2-methyl-5-isopropyl-8-mercapto-4,5-nonanediol, 7-(2-methyl-5-mercaptopentyl)-7,8-tetradecanediol, 9-octyl-10-(6-mercaptohexyl)-9,10-octadecanediol, 1-(4-mercaptocyclohexyl)-1,2-diphenyl-1,2-ethanediol, 1-(3-mercaptocyclopentyl)-1,2-di-m-tolyl-1,2-ethanediol, 1,4-diphenyl-2-(2-mercaptophenyl)-2,3-butanediol, 1-(3-mercaptophenyl)-1,2-dicyclohexyl-1,2-ethanediol, 1-mercapto-2-(3-methylcyclopentyl)-4-cyclohexyl-2,3-butanediol, and the like, and mixtures thereof.

As indicated above, the 2-hydroxy-4-(mercaptohydrocarbyl)-1,3,2-dioxaborolane is produced by contacting boric acid with the mercapto-substituted vicinal diol in a molar ratio of substantially 1:1, with removal of by-product water. Similarly, the hydrogen bis-[(mercaptohydrocarbyl)ethylenedioxy]borate is produced by contacting boric acid with the mercapto-substituted vicinal diol in a molar ratio of substantially 0.5:1, respectively, with removal of by-product water. Except for the difference in mole ratio of reactants, each of these two processes can be conducted within the same range of reaction conditions. Thus, although the reaction temperature can vary over a considerable range, generally it will be within the range of about 60° to about 170° C, preferably being within the range of about 70° to about 155° C. The reaction time can vary greatly, depending in part on the reaction temperature. Generally the reactants are heated together for about 10 minutes to about 4 hours, preferably for about 20 minutes to about 3 hours. The pressure is not critical but should be sufficient to maintain the organic components substantially in the liquid phase. For convenience, substantially atmospheric pressure is preferred. A hydrocarbon such as benzene, toluene, or xylene is then added, and the resulting mixture is heated to remove by-product water in an azeotropic distillation step. The azeotropic distillation should be continued until essentially no more water is produced as evidenced by the presence of essentially no additional water in the distillate. The hydrocarbon can then be distilled to provide as the residual product the desired 2-hydroxy-4-(mercaptohydrocarbyl)-1,3,2-dioxaborolane or the hydrogen bis[(mercaptohydrocarbyl)ethylenedioxy]-borate.

Although the alkylammonium bis[(mercaptohydrocarbyl)ethylenedioxy]-borate can be produced by contacting the hydrogen bis[(mercaptohydrocarbyl)ethylenedioxy]borate, isolated as above, with the alkylamines and preferably a hydrocarbon diluent such as benzene, toluene, or xylene, it is preferable to contact the alkylamine directly with the hydrocarbon solution of the hydrogen bis[(mercaptohydrocarbyl)ethylenedioxy]borate, without prior separation of the hydrocarbon diluent. The temperature at which the reaction is conducted is not critical but generally will be within the range of about 20° to about 170° C, preferably being within the range of about 30° to about 120° C. Although the reaction time can vary greatly, depending in part on the reaction temperature, generally it will be within the range of about 1 minute to about 1 hour, preferably within the range of about 5 minutes to about 30 minutes, or until the mixture is essentially clear. The pressure is not critical but should be sufficient to maintain the components of the mixture substantially in the liquid phase. For convenience, atmospheric pressure is preferred. The hydrocarbon diluent, if used, can then be distilled to provide as the residual product the desired alkylammonium bis[(mercaptohydrocarbyl)ethylenedioxy]borate.

The lubricant composition into which the mercapto-substituted boron-containing antiwear additive is formulated can be any such lubricating composition in which antiwear properties are desirable. Thus, each compositions can include motor oils, greases, automatic transmission oils, cutting oils, hydraulic fluids, and other lubricating compositions comprising mineral oil.

These lubricating compositions are based on mineral oils such as those of petroleum origin and are preferably refined mineral oils produced by well-known refining processes employing techniques such as hydrogenation, polymerization, dewaxing, solvent extraction, etc. These oils generally have a Saybolt viscosity at 100° F (38° C) within the range of about 60 to about 5,000 SUS and a Saybolt viscosity at 210° F (99° C) within the range of about 30 to about 250 SUS. The mineral oils can be paraffinic, naphthenic, or aromatic, or mixtures of these.

When such lubricants are in the form of a grease, the lubricant composition will contain a suitable grease thickener such as a lithium soap or a hydrocarbon polymer. Such grease compositions are well-known in the art, and they are generally prepared by dissolving soaps and/or polymers in the oil at elevated temperatures.

The amount of mercapto-substituted boron-containing antiwear additive in the lubricating composition can vary, depending in part on the nature of the lubricant and the specific lubricating application, but generally will be within the range of about 0.02 to about 4, preferably within the range of about 0.1 to about 3, percent by weight of the total lubricating composition, including antiwear additive.

In addition to the antiwear additive, the lubricating composition can contain other conventional components such as antioxidants, viscosity index improvers, dispersants, pour point depressants, antifoam agents, anticorrosion agents, and the like.

EXAMPLE I

2-Hydroxy-4-(mercaptomethyl)-1,3,2-dioxaborolane was prepared in the following manner.

A mixture of 6.2 g (0.1 mole) boric acid and 10.8 g (0.1 mole) 3-mercapto-1,2-propanediol was stirred at 80° C for 2 hours. Then 150 ml toluene was added, and the mixture was heated to remove water in an azeotropic distillation step. A total of 4.3 ml water was thus removed. A small amount of white solid was allowed to settle from the resulting reaction mixture, the toluene solution was decanted from the solid, and toluene was distilled under reduced pressure from the toluene solution, leaving 9.1 g of 2-hydroxy-4-(mercaptomethyl)-1,3,2-dioxaborolane as a viscous, hazy liquid.

EXAMPLE II

Octadecylammonium bis[(mercaptomethyl)ethylenedioxy]borate was prepared as follows.

A mixture of 6.2 g (0.1 mole) boric acid and 21.6 g (0.2 mole) 3-mercapto-1,2-propanediol was stirred at 80° C for 30 minutes under a nitrogen atmosphere. A portion of the boric acid remained undissolved. Then 200 ml toluene was added, and the mixture was heated to remove water in an azeotropic distillation step. A total of 5.8 ml water was thus removed. To the resulting reaction mixture comprising hydrogen bis[(mercaptomethyl)ethylenedioxy]borate was added 26.9 g (0.1 mole) octadecylamine in 100 ml toluene, and the mixture thus formed was stirred at 80°-90° C until it became clear. The toluene was then distilled from the toluene solution, leaving 50.5 g of octadecylammonium bis[(mercaptomethyl)ethylenedioxy]borate as a pale yellow liquid which solidified on cooling.

EXAMPLE III

2-Hydroxy-4-(mercaptomethyl)-1,3,2-dioxaborolane, prepared in Example I, and octadecylammonium bis[(mercaptomethyl)ethylenedioxy]borate, prepared in Example II, were evaluated as antiwear additives in an ashless lubricating oil formulation. Also evaluated, for the purpose of comparison, was the ashless lubricating oil formulation without antiwear additive.

The composition of the ashless lubricating oil formulation, without antiwear additive of this invention, was as shown in Table I.

Table I

| Weight % | Component | Purpose |
|---|---|---|
| 66.62 | Lubricating oil[a] | |
| 24.08 | Phil-Ad[b]VII solution[c] | Viscosity index improver |
| 7.50 | Lubrizol[b]925 additive[d] | Dispersant |
| 0.20 | Acryloid[b]152 additive[e] | Pour point depressant |
| 0.10 | Vanlube[b]PN additive[f] | Antioxidant |
| 1.00 | Vanlube[b]SS additive[g] | Antioxidant |
| 0.50 | Ethyl[b]702 additive[h] | Antioxidant |

[a]A refined, generally paraffinic mid-continent lubricating oil blend.
[b]A trademark.
[c]A 10 weight percent solution of a hydrogenated butadiene-styrene copolymer in a reinfed, generally paraffinic mid-continent lubricating oil.
[d]A mixture of polyisobutenyl succinimide and polyisobutenyl succinamide.
[e]A polymethacrylate-based resin.
[f]Phenyl-beta-naphthylamine.
[g]Mixture of octylated diphenylamines.
[h]4,4''-Methylenebis(2,6-di-tert-butylphenol).

The wear tests were carried out using the well-known Falex test machine in accordance with a slight modification of the ASTM D 2670-67 procedure. In the procedure used, a rotating steel pin, 0.635 cm (0.25 in) in diameter was rotated at 290 rpm between two 37 V" steel blocks for one-half hour of break-in at an applied load of 23 kg (50 lb) followed by three hours of additional testing at 113 kg (250 lb) applied load. During this time, the rotating pin and "V" blocks were submerged in 60 g of the test oil. During the break-in period, the oil, pin and "V" blocks were heated to 79.5° C. However, the temperature was not controlled during the test period but was allowed to increase or decrease depending upon the amount of frictional heat produced during the tests. The wear was measured by the number of radial degrees or teeth which a ratchet wheel pressure loader must be advanced to maintain a constant pressure during the course of the test. A lubricant composition with good antiwear properties would result in a wear equivalent to a relatively few teeth (less than 30) whereas a lubricating composition with poor antiwear properties would require the wheel to be turned through many teeth (more than 50).

The results are summarized in Table II.

Table II

| Antiwear Additive | Additive Level, Weight %[a] | Wear, Number of Teeth |
|---|---|---|
| None | 0 | >>100[b] |
| A[c] | 2.0 | 29 |
| B[d] | 2.0 | 13 |

[a]Based on total weight of ashless lubricating oil formulation plus antiwear additive.
[b]Excessive wear led to catastrophic failure.
[c]2-Hydroxy-4-(mercaptomethyl)-1,3,2-dioxaborolane.
[d]Octadecylammonium bis[(mercaptometyl)ethylene-dioxy]borate.

Thus, 2-hydroxy-4-(mercaptomethyl)-1,3,2-dioxaborolane and octadecylammonium bis[(mercaptomethyl)ethylenedioxy]borate were each effective as antiwear additives, each of them improving the antiwear properties of the lubricating oil into which the antiwear additive was incorporated.

We claim:

1. A lubricating composition comprising a major amount of an oil based lubricant and a minor antiwear improving amount of at least one mercapto-substituted boron-containing compound selected from the group consisting of 2-hydroxy-4-(mercaptohydrocarbyl)-1,3,2-dioxaborolanes and alkylammonium bis[(mercaptohydrocarbyl)ethylenedioxy]borates.

2. A lubricating composition of claim 1 wherein said lubricating composition comprises a lubricant based on mineral oil.

3. A lubricating composition of claim 2 wherein said mercapto-substituted boron-containing compound is 2-hydroxy-4-(mercaptomethyl)-1,3,2-dioxaborolane.

4. A lubricating composition of claim 2 wherein said mercapto-substituted boron-containing compound is octadecylammonium bis[(mercaptomethyl)-ethylenedioxy]borate.

5. As a novel composition of matter a 2-hydroxy-4-(mercaptohydrocarbyl)-1,3,2-dioxaborolane.

6. 2-Hydroxy-4-(mercaptomethyl)-1,3,2-dioxaborolane as a composition of matter of claim 5.

7. As a novel composition of matter an alkylammonium bis[(mercaptohydrocarbyl)ethylenedioxy]borate.

8. Octadecylammonium bis[(mercaptomethyl)ethylenedioxy]borate as a composition of matter of claim 7.

9. As a novel composition of matter a hydrogen bis[(mercaptohydrocarbyl) ethylenedioxy]borate.

10. Hydrogen bis[(mercaptomethyl)ethylenedioxy]borate as a novel composition of matter of claim 10.

11. A method for improving antiwear properties of an oil based lubricating composition, said method comprising the addition of at least one mercaptosubstituted boron-containing compound selected from the group consisting of 2-hydroxy-4-(mercaptohydrocarbyl)-1,3,2-dioxaborolanes and alkylammonium bis[(mercaptohydrocarbyl)ethylenedioxy]borates to said oil based lubricating composition.

12. A method of claim 11 wherein said mercapto-substituted boron-containing compound is 2-hydroxy-4-(mercaptomethyl)-1,3,2-dioxaborolane.

13. A method of claim 11 wherein said mercapto-substituted boron-containing compound is octadecylammonium bis[(mercaptomethyl)ethylenedioxy]-borate.

14. A method for preparing a 2-hydroxy-4-(mercaptohydrocarbyl)-1,3,2dioxaborolane, said method comprising contacting boric acid with a mercapto-substituted vicinal diol in a molar ratio of substantially 1:1. dioxaborolane,

15. A method of claim 14 wherein by-product water is removed from the product mixture.

16. A method of claim 14 wherein said 2-hydroxy-4-(mercaptohydrocarbyl)-1,3,2-dioxaborolane is 2-hydroxy-4-(mercaptomethyl)-1,3,2-dioxaborolane and said mercapto-substituted vicinal diol is 3-mercapto-1,2-propanediol.

17. A method for preparing a hydrogen bis[mercaptohydrocarbyl)-ethylenedioxy]borate, said method comprising contacting boric acid with a mercapto-substituted vicinal diol in a molar ratio of substantially 0.5:1.

18. A method of claim 17 wherein by-product water is removed from the product mixture.

19. A method of claim 17 wherein said hydrogen bis[(mercaptohydrocarbyl)ethylenedioxy]borate is hydrogen bis[(mercaptomethyl)ethylenedioxy]-borate and said mercapto-substituted vicinal diol is 3-mercapto-1,2-propane-diol.

20. A method for preparing alkylammonium bis[(mercaptohydrocarbyl)-ethylenedioxy]borates, said method comprising contacting a hydrogen bis[(mercaptohydrocarbyl)ethylenedioxy]borate with an alkylamine.

21. A method of claim 22 wherein said contacting is in the presence of a hydrocarbon diluent.

22. A method of claim 21 wherein said hydrocarbon diluent is chosen from among benzene, toluene, and xylene.

23. A method of claim 20 wherein said alkylammonium bis[(mercaptohydrocarbyl)ethylenedioxy]borate is octadecylammonium bis[(mercaptomethyl)-ethylenedioxy]borate, said hydrogen bis[(mercaptohydrocarbyl]ethylenedioxy]-borate is hydrogen bis[(mercaptomethyl)ethylenedioxy]borate, and said alkylamine is octadecylamine.

24. A method of claim 19 wherein by-product water is removed by azeotropic distillation after addition of a hydrocarbon diluent to the product mixture.

25. A method of claim 18 wherein by-product water is removed by azeotropic distillation after addition of a hydrocarbon diluent to the product mixture.

* * * * *

UNITED STATES PATENT AND TRADEMARK OFFICE

CERTIFICATE OF CORRECTION

PATENT NO. : 4,115,286

DATED : September 19, 1978

INVENTOR(S) : Bernard A. Baldwin, Ralph P. Williams, Raymond Rohde

It is certified that error appears in the above-identified patent and that said Letters Patent are hereby corrected as shown below:

Column 7, line 40, "bis[(mercaptomethyl)-ethylenedi-" should be ---bis[(mercaptomethyl)ethylenedi- -; line 55, "10" should be --- 9 ---; line 58, "mercaptosubstituted" should be --- mercapto-substituted ---; Column 8, line 10, "bis[(mercaptomethyl)ethylenedioxy]-borate" should be --- bis[(mercaptomethyl)ethylenedioxy]borate ---; line 12, "tohydrocarbyl)-1,3,2dioxaborolane" should be --- tohydrocarbyl)-1,3,2-dioxaborolane ---; lines 24 & 25, "bis[mercaptohydrocarbyl)-ethylenedioxy]borate" should be --- bis[(mercaptohydrocarbyl)ethylenedioxyl]borate ---; Column 8, line 33, "drogen bis [(mercaptomethyl)ethylenedioxy]-borate" should be --- drogen bis[(mercaptomethyl) ethylenedioxy]borate ---; line 37, "captohydrocarbyl)-ethylenedioxy]borates" should be --- captohydrocarbyl)ethylenedioxy[borates ---; line 40, "22" should be ---20 ---; line 50, "drocarbyl]ethylenedioxy]-borate" should be --- drocarbyl)ethylenedioxy]borate ---; line 53, "19" should be --- 15 ---.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*